US005249386A

United States Patent [19]

Switzer

[11] Patent Number: 5,249,386

[45] Date of Patent: Oct. 5, 1993

[54] CARTRIDGE CLIP RELOADER

[76] Inventor: Robert D. Switzer, 2200 N. Ft. Thomas Ave., Ft. Thomas, Ky. 41075

[21] Appl. No.: 935,547

[22] Filed: Aug. 26, 1992

[51] Int. Cl.[5] ..... F41A 9/83

[52] U.S. Cl. ..... 42/87

[58] Field of Search ..... 42/87, 88, 89, 90

[56] References Cited

FOREIGN PATENT DOCUMENTS 304379 10/1917 Fed. Rep. of Germany ..... 42/87

555367 8/1943 United Kingdom ..... 42/90

*Primary Examiner*—Stephen C. Bentley

*Attorney, Agent, or Firm*—Wood, Herron & Evans

[57] ABSTRACT

A reloader for a cartridge clip that allows the reloader and clip, when assembled for reloading purposes, to be held and operated in one of a user's hands while cartridges are reloaded in the clip with the other of the user's hands. The reloader includes a sleeve adapted to receive the clip in seated relation during reloading, and a handle connected to the sleeve against which the clip lies when the clip is in operational relation with the reloader, thereby allowing the clip and reloader to be held in operational assembly with one of the user's hands. The reloader also includes a plunger that is manually reciprocable to depress a top cartridge already seated in the cartridge clip to accommodate receiving another cartridge as a successor top cartridge in the cartridge clip. An operator arm connected with the plunger is manually operable by the user's thumb on that same one of the user's hands that holds the cartridge and clip in operational assembly, thereby leaving the other of the user's hands free to reload cartridges in the cartridge clip.

33 Claims, 3 Drawing Sheets

CARTRIDGE CLIP RELOADER

This invention relates to cartridge clips for guns. More particularly, this invention relates to a reloader for cartridge clips.

Guns, particularly handguns such as pistols, are commonly structured to receive cartridge clips. The cartridge clip carries a series of cartridges or bullets, and is adapted to feed those bullets one at a time in succession to the gun's firing chamber. This cartridge clip approach to hand guns allows the hand gun to fire a series of cartridges, e.g., six or eight or more, without need for hand loading cartridges one at a time to the gun. And the cartridge clip allows plural cartridges, e.g., six or eight or more, to be easily loaded in proper firing sequence with the gun simply by loading a single clip into the gun.

The basic structure of a cartridge clip includes a magazine with an ejection end and a closed end in combination with a compression spring positioned within that magazine. The cartridges are loaded sequentially within the magazine against the compression force exerted by the spring. Once loaded in the clip, the cartridges are spring loaded toward the ejection end for subsequent ejection therefrom when the clip is loaded in a gun.

A substantial spring force must be available in a cartridge clip in order to properly move a succeeding cartridge in sequence to the clip's ejection end after a preceding cartridge has been ejected from the clip. When the clip is reloaded, i.e., after all cartridges have been ejected from the clip, the compression spring must be compressed sequentially in response to the loading of each individual cartridge until the clip's maximum cartridge supply is received. Now the more cartridges that are put into the clip when reloading the clip, the greater the resistance of the compression spring against further compression. And this means that the last cartridge loaded into the clip is significantly harder to load than the first cartridge load into the clip.

Therefor, it has been the primary objective of this invention to provide an improved reloader for a cartridge clip in which the compression force exerted by the compression spring interiorly of the clip's magazine can be eliminated when it is desired to load a successor top cartridge in the cartridge clip, same being accomplished by providing a reloader structure which allows the cartridge clip and reloader to be held in operational assembly by one of a user's hands while allowing the reloader to be manually operable by the thumb of that same one of the user's hands, thereby leaving the other of the user's hands free to reload cartridges in the cartridge clip.

It has been another objective of this invention to provide an improved reloader for a cartridge clip where the reloader's sleeve that is adapted to receive the cartridge clip in seated relation during reloading of the clip is open at a section of its periphery so that the cartridge clip can be engaged with and disengaged from the sleeve in a direction generally normal to the sleeve's longitudinal axis, in combination with a handle connected to the sleeve which allows the clip to lay against that handle when the clip is engaged in operational relation with the reloader so that one of a user's hands can manually grip the cartridge clip and the handle to aid in maintaining operational assembly of the clip with the reloader during use.

It has been a further objective of this invention to provide an improved reloader for a cartridge clip where the reloader includes a plunger that is manually reciprocable to depress a top cartridge already seated in the cartridge clip to accommodate receiving another cartridge as a successor top cartridge in the cartridge clip in combination with an operator arm connected with the plunger for reciprocating same where that operator arm is manually operable by a user's thumb and is oriented to at least partially close an open section of the sleeve's periphery during use of the reloader so as to aid in holding a cartridge clip in operational assembly with the reloader where the reloader's sleeve is open along a section of its periphery to accommodate operational assembly of the cartridge clip with the reloader.

It has been still a further objective of this invention to provide an improved reloader for a cartridge clip that includes a sleeve adapted to receive the clip in seated relation during reloading which includes an adjustable stop connected with the sleeve that is adjustable to accommodate cartridge clips of at least first and second different lengths so as to present the open end of each cartridge clip, whether of the first or second length, at about the same location relative to the sleeve when either length cartridge clip is engaged in operational relation with the reloader.

Other objectives and advantages of this invention will be more apparent from the following detailed description taken in conjunction with the drawings in which.

Figure 6:
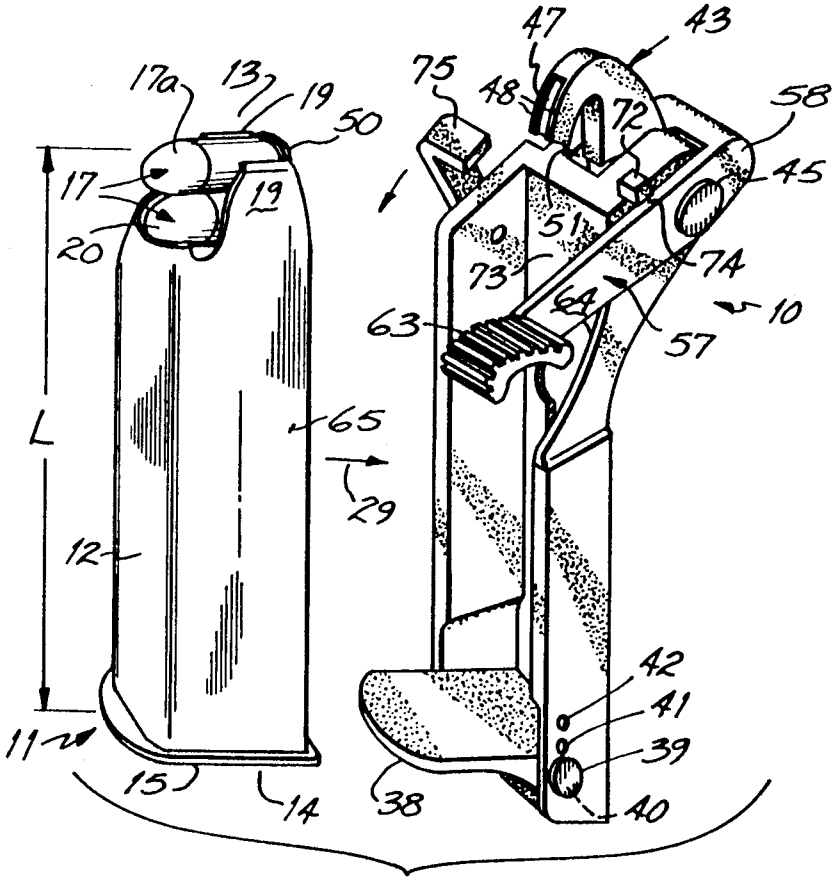
FIG. 6 is a perspective view of an alternative reloader embodiment in accord with the principles of this invention.
Figure 3:
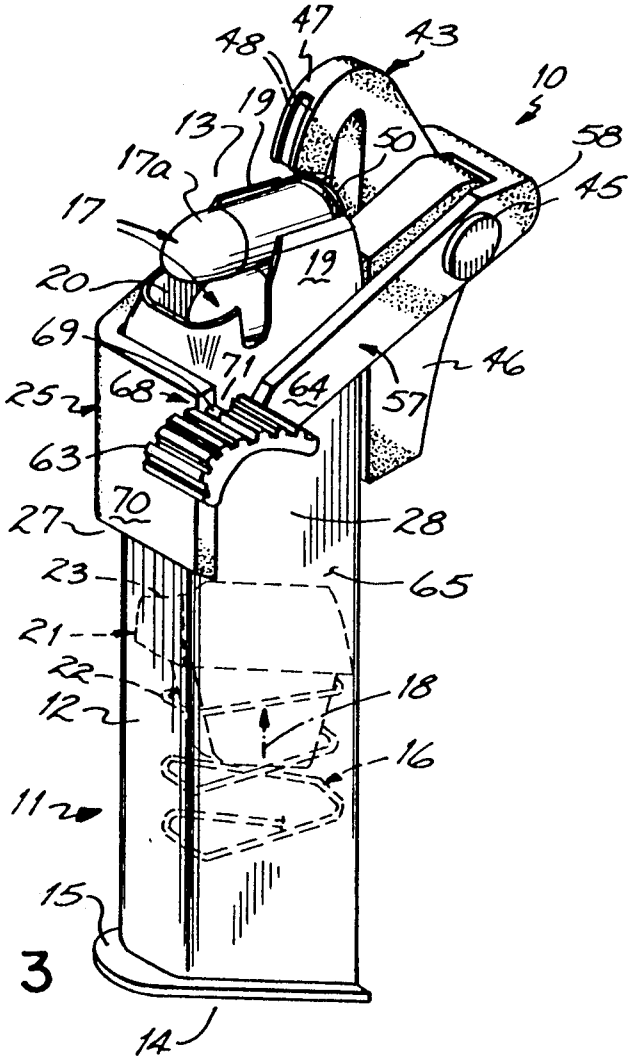
FIG. 3 is a view similar to FIG. 1 but illustrating a reloader having a cartridge clip in operational assembly therewith.

The reloader 10 of this invention is adapted for use with a cartridge clip 11 of the type particularly shown in FIGS. 3 and 6. The cartridge clip basically includes a magazine 12 with an ejection end 13 and a closed end 14 that includes flange 15. A compression spring 16 is positioned within the magazine 12, cartridges 17 that are loaded into the magazine being spring loaded in the direction shown by phantom arrow 18 toward the magazine's ejection end 13 for subsequent ejection therefrom when the clip 11 is installed with a gun (not shown). The magazine 12 is in the form of a tubular housing with its upper or ejection end 13 having inwardly flared side walls 19 that neck down to define an ejection slot 20 at that open end. The upper flared side walls 19 are sized and configured to prevent ejection of the cartridges 17 in the phantom arrow 18 direction. The compression spring 16 is in the form of a coil spring which seats a cartridge follower 21 in its top loop 22. The follower 21 includes a formed upper surface 23 against which the lowest cartridge 17 in a stack of cartridges within the clip 11 rests when the clip is ready for use.

Figure 1:
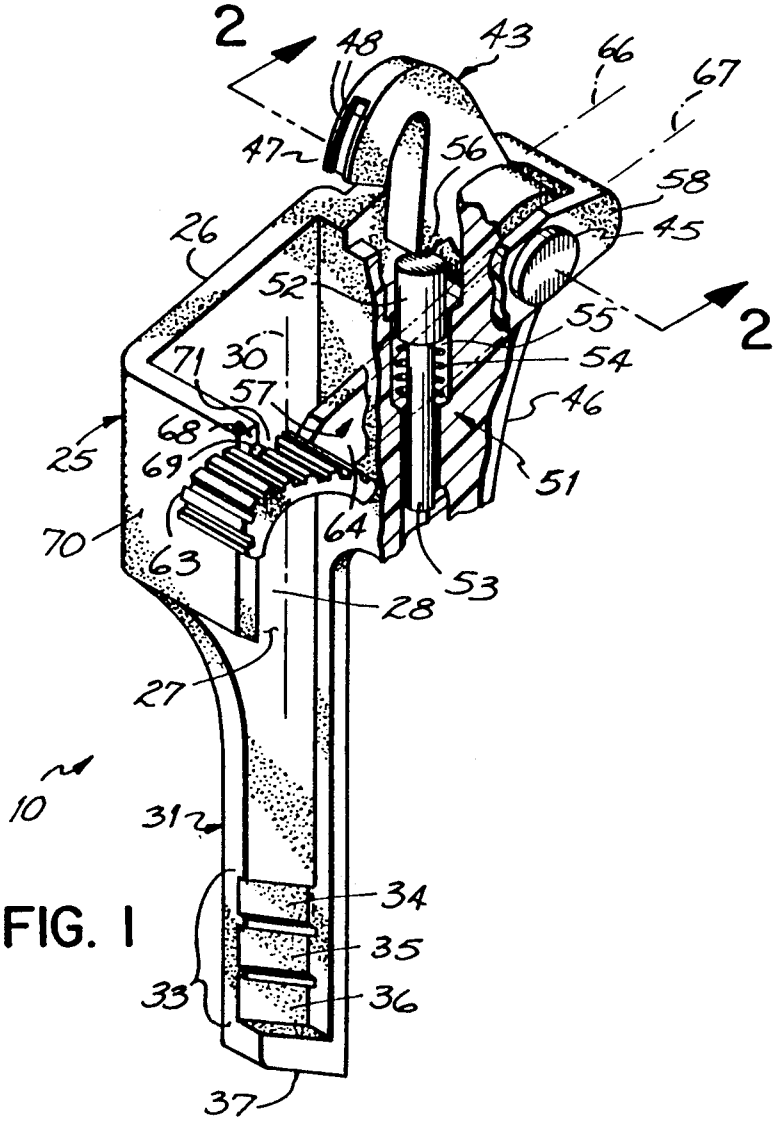
FIG. 1 is a partially broken away perspective view of a cartridge clip reloader in accord with the principles of this invention.

A reloader 10 in accord with the principles of this invention is illustrated in FIG. 1. The reloader 10 includes a sleeve 25 adapted to receive the cartridge clip 11 in seated relation during reloading. The sleeve 25 is open at its top end 26 and also at its bottom end 27. The sleeve 25 is also open at a section 28 of its periphery, and this provides the sleeve with a generally C-shaped cross-sectional configuration. The open top end 26 and open peripheral section 28 of the sleeve, in the FIG. 6 alternative embodiment described in further detail below, allow the cartridge clip 11 to be engaged with and disengaged from the sleeve 25 in a direction (illustrated by phantom arrow 29) generally normal to the sleeve's longitudinal axis 30. A handle 31 is connected to the sleeve 25, and indeed formed integral with the sleeve. The cartridge clip 11 is adapted to lay against the handle 31 when the cartridge clip is engaged in operational relation with the reloader 10. Hence, a user of the reloader 10 manually grips in one hand 32 both the cartridge clip 11 and the handle 31 to aid in maintaining operational assembly of the cartridge clip with the reloader during use, see particularly FIG. 4.

A stop 33 is connected with the handle 31, the stop providing a support against which the closed end 14 of the cartridge clip 11 is abutted when the clip is engaged in operational relation with the reloader 10. Preferably this stop 33 is an adjustable stop, the stop being adjustable to accommodate cartridge clips 11 of first, second and third different lengths with the sleeve 25 so as to present the open end 13 of the cartridge clip, whether of the first or the second or the third length, at about the same location relative to the sleeve when either of the first or second or third length cartridge clips is engaged in operational relation with the reloader 10. In the FIG. 1 embodiment, the adjustable stop 33 is provided by three grooves 34–36 at the bottom end 37 of the handle 31. The three grooves 34–36 are each sized to receive the flange 15 carried by the cartridge clip 11 at the clip's closed end 14. That one of the three grooves 34–36 used when the cartridge clip 11 is in operational relation with the reloader 10 depends on whether the clip is of the first or second or the third length. The adjustable stop 33, in the alternative reloader embodiment illustrated in FIG. 6, is in the form of an adjustable floor 38 connected to the handle 31. The floor 38 is movable relative to the handle 31, and is held thereto by a pin 39 that cooperates with bores 40–42 located on each side of the handle. The connection position of the floor 38 with the handle 31 is changed depending on whether a cartridge clip 11 of the first or second or third length is to be reloaded.

Figure 5:
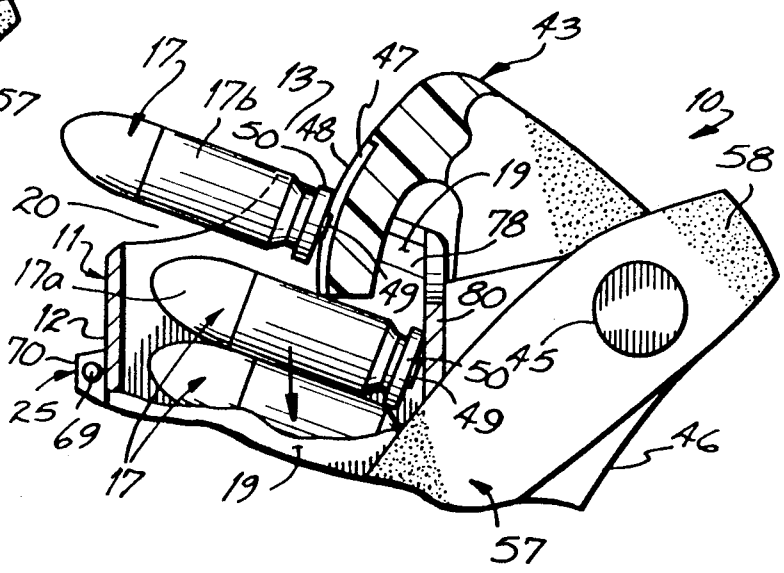
FIG. 5 is a blown up view of the top portion of the reloader in the operational position illustrated in FIG. 4.
Figure 4:
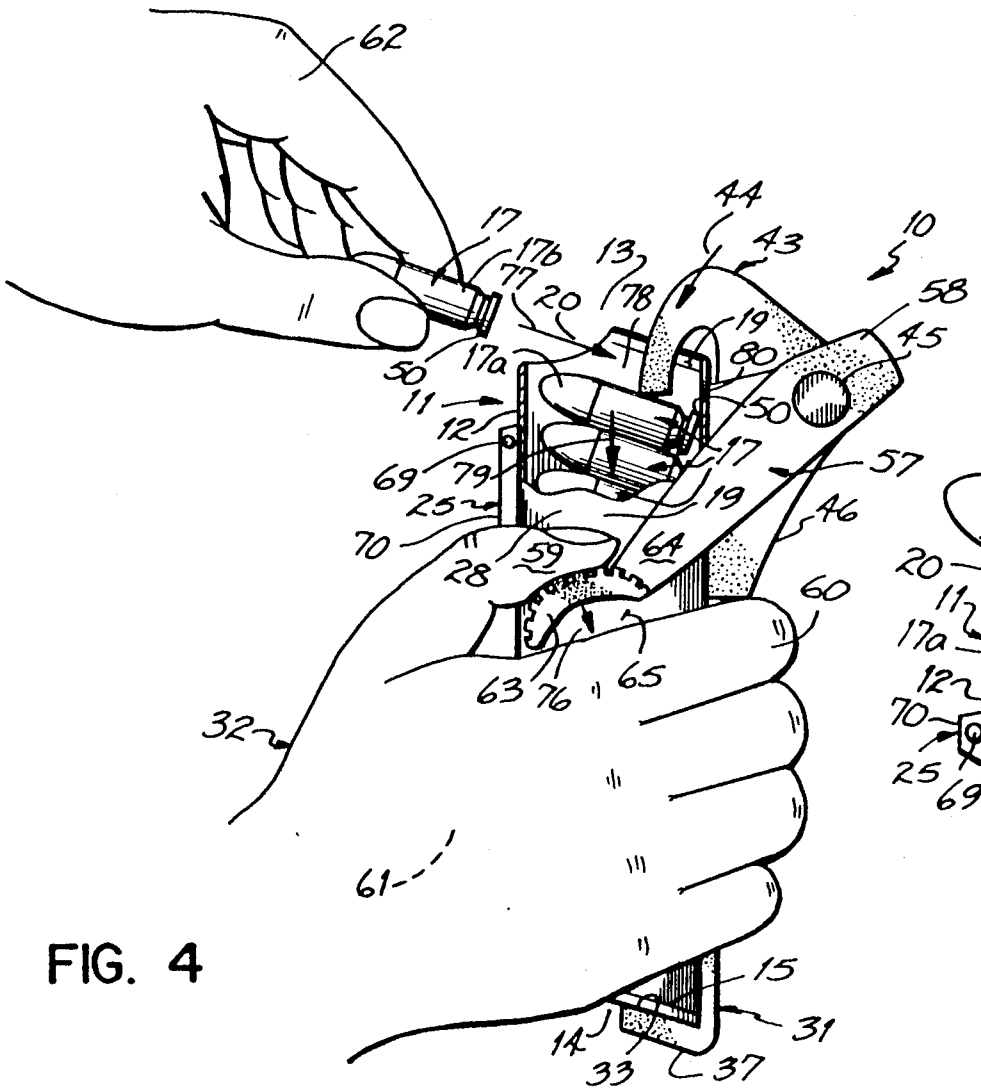
FIG. 4 is a side operational view illustrating use of the reloader shown in FIGS. 1-3.

A plunger 43, in the form of a crooked finger, is connected with the reloader 10. The plunger 43 is manually reciprocable in a direction shown by phantom arrow 44 to depress a top cartridge 17*a* already seated in the cartridge clip to accommodate receiving another cartridge 17*b* as a successor cartridge in the cartridge clip 11 when the clip is operationally engaged with the reloader, see FIGS. 4 and 5. The plunger 43 is fixed to an axle 45 that is journaled in bracket 46 fixed to the reloader's sleeve 25. The plunger 43 includes a groove 47 in its cartridge flange contact surface 48. The groove 47 prevents contact of a cartridge's primer 49 with the plunger's cartridge flange contact surface 48 while allowing contact of the cartridge's flange 50 with the plunger's contact surface 48 during reloading of a successor top cartridge 17*b* in the cartridge clip 11, note particularly FIG. 5. A spring unit 51 continuously biases the plunger 43 to that ready position illustrated in FIGS. 1 and 3. In the ready position, the plunger 43 is out of contact with the top cartridge 17*a* already seated in the cartridge clip 11. The plunger 43 is reciprocated against the bias of the spring unit 51 to move the plunger to a depress position, as shown in FIGS. 4 and 5, where the top cartridge 17*a* already seated in the cartridge clip 11 is depressed to accommodate receiving another cartridge 17*b* as a successor top cartridge. The spring unit 51 includes a piston 52 and a piston rod 53, and a coil compression spring 54 that surrounds the piston rod, this assembly being located in a seat 55 defined in the reloader's bracket 46. Specifically, the piston 52 continuously bears against the plunger's foot 52 as biased by the coil spring 54, the coil spring being seated in the bracket's seat 55, to continually bias the plunger 43 to the ready position.

Figure 2:
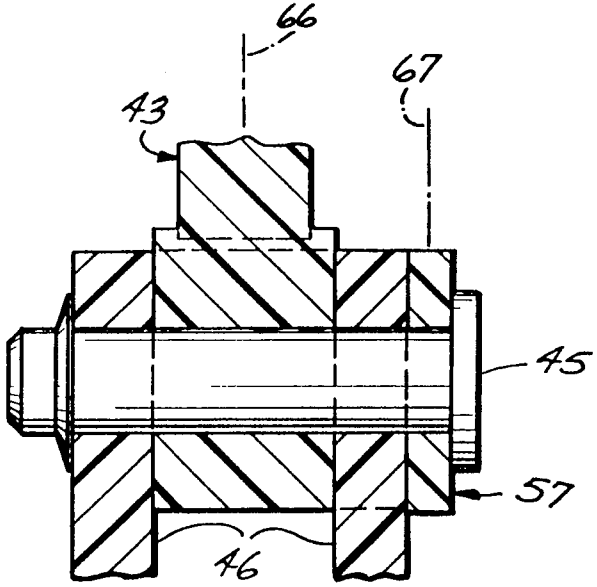
FIG. 2 is a cross sectional view taken along line 2—2 of FIG. 1.

An operator arm 57 is connected with the plunger 43 for reciprocating the plunger, the operator arm being fixed to axle 45 at one end 58. A thumb rest 63 is connected to the operator arm at its other end 64. Note particularly in both the FIGS. 1 and 6 embodiments that the operator arm 57 is oriented to at least partially close the open peripheral section 28 of the sleeve 25 during use of the reloader 10 so as to aid in holding the cartridge clip 11 in operational assembly with the reloader, see FIG. 3. The operator arm 57 is manually operable by a user's thumb 59 on one of a user's hands 32 to reciprocate the plunger 43 while manually gripping the cartridge clip and handle 31 by the fingers 60 and palm 61 of that same one of the user's hands when the cartridge clip is in operational relation with the reloader, thereby leaving the other 62 of the user's hands free to reload cartridges 17*b* in the cartridge clip, see particularly FIG. 4. So the operator arm 57 is pivotally connected to the sleeve 25 adjacent one side thereof and the thumb rest 63 is connected to the operator arm adjacent an opposite side of the sleeve. Further, the operator arm 57 is located or positioned outboard of a side 65 of the cartridge clip 11, and the thumb rest 63 is located between the open 13 and closed 14 ends of the cartridge clip, when the cartridge clip is engaged in operational relation with the reloader. Note particularly from FIGS. 1 and 2 that this structural relationship of the operator arm 57 with the plunger 43 allows the plunger to reciprocate in a first operational plane 66 and the operator arm to reciprocate in a second operational plane 67, those operational planes being parallel to but spaced from one another.

The spring unit 51 also includes an upstop 68 connected with the plunger 43, the upstop cooperating with the operating arm 57 to locate the plunger in the ready position in response to the spring 54 bias, as illustrated in FIGS. 1 and 3. This upstop 68, in the FIG. 1 embodiment, is comprised of a detent 69 fixed to the front side 70 of the sleeve 25 which cooperates with an abutment 71 in the form of a seat defined on the top surface of the operator arm's thumb rest 63, the detent being located in that thumb rest seat to locate the plunger 43 in the ready position. The upstop 68, in the FIG. 6 embodiment, is comprised of a detent 72 fixed to the rear side 73 of the sleeve 25 which cooperates with an abutment 74 in the form of the operator arm's top edge so as to locate the plunger 43 in the ready position.

The sleeves 25 of both the FIG. 1 and FIG. 6 embodiment, as earlier noted, are both of a generally C-shaped configuration, thereby providing a section 28 of each sleeve's periphery that is open. In the FIG. 1 embodiment, that open section 28 is closed during use by the reloader's operator arm 57. In the FIG. 6 embodiment, the reloader's operator arm 57 also functions as a side of the sleeve. But in the FIG. 6 embodiment, a latch device 75 is provided that is movable between a latch position (not shown) where a cartridge clip 11 is restrained within the sleeve, and an unlatch position (shown in solid lines) where the cartridge clip can be removed from operational assembly with the reloader. This latch device 75, in the FIG. 6 embodiment, cooperates in maintaining the cartridge clip in operational assembly with the reloader 10 during use.

Use of the FIGS. 1–5 embodiment of the reloader of this invention is particularly illustrated in FIGS. 3–5. As shown, a cartridge clip 11 is initially installed with the reloader 10, the clip's flange 15 being seated in that one of the three grooves 34–36 which is appropriate depending on the clip's length L in order to position the clip's open top end 13 in proper operational relation with the reloader's plunger 43. With the cartridge clip 11 and reloader 10 so assembled, a user's one hand 32 grips the clip 11 and handle 31 as illustrated in FIG. 4. The thumb 59 of that same user's hand 32 then depresses the operator arm 57 in the direction shown by phantom arrow 76 so as to cause the plunger 43 to depress the top cartridge 17*a* in the cartridge clip 11. With the top cartridge 17*a* in the cartridge clip 11 so depressed, and as illustrated in FIGS. 4 and 5, the user's other hand 62 then installs a successor top cartridge 17*b* in a direction shown by phantom arrow 77 within the clip's top end 13, the space 78 provided for insertion of that new successor top cartridge 17*b* being created because the plunger 43 pushes down against the clip's compression spring 16 in the direction shown by phantom arrow 79 those cartridges 17 previously loaded in the cartridge clip 11. With the new successor top cartridge 17*b* then positioned as illustrated in FIG. 5, the reloader's operator arm 57 can be released by the user's thumb 59 so that the successor top cartridge can be pushed into its final position where the cartridge's flange 50 abuts the clip's rear wall 80. In other words, the plunger 43, being continuously spring 54 biased toward the ready position illustrated in FIG. 3, the operator need only release the operator arm 57 to remove the plunger from the spring clip 11. As the plunger 43 is spring 54 biased out of the clip's interior, the plunger's cartridge contact surface 48 does not contact the cartridge's primer 49 because that primer rides in the plunger's groove 47. Successor top cartridges 17*b* are thereafter installed in the cartridge clip 11 until the cartridge clip is full.

Use of the FIG. 6 embodiment, from the standpoint of the operator arm 57 and plunger 43, is the same as use of the FIGS. 1–5 embodiment. On the other hand, in the FIG. 6 embodiment the reloader's floor 38 is initially positioned in the proper location by pin 39 and bores 40–42 depending on the clip's length L. Further, the clip 11 itself is installed with the reloader 10 in a direction laterally, as shown by phantom arrow 29 of the clip's longitudinal axis 81 so as to locate it easily within the reloader's sleeve 25 and against the reloader's handle 31. With the clip 11 so seated (in a position not shown) the reloader's latch 75 is dropped from the unlatch position shown to the latch position (not shown) where it also aids in holding the cartridge clip in operational assembly with the reloader 10.

Having described in detail the preferred embodiment of my invention, what I desire to claim and protect by Letters Patent is:

1. A reloader for a cartridge clip, said cartridge clip having an open end and a closed end, said reloader comprising a sleeve adapted to receive a cartridge clip in seated relation during reloading, said sleeve being open at its top end, a handle connected to said sleeve, said cartridge clip being adapted to lay on said handle when said cartridge clip is engaged in operational relation with said reloader, a user of said reloader manually gripping in one hand both said cartridge clip and said handle to aid in maintaining operational assembly of said cartridge clip with said reloader during use, a plunger connected with said reloader, said plunger being manually depressible to depress a top cartridge already seated in said cartridge clip to accommodate receiving another cartridge as a successor top cartridge in said cartridge clip when said cartridge clip is operationally engaged with said reloader, and an operator arm connected with said plunger for reciprocating said plunger, said operator arm being manually depressible by a user's thumb on one of a user's hands to depress said plunger while manually gripping said cartridge clip and said handle by the fingers and palm with that same one of the user's hands when said cartridge clip is in operational relation with said reloader, said operator arm being manually depressible by said user's thumb in the same operational direction as said top cartridge is depressed within said cartridge clip, thereby leaving the other of the user's hands free to reload cartridges in said cartridge clip.

2. A reloader as set forth in claim 1, said reloader comprising a thumb rest connected to said operator arm, said operator arm being pivotally connected to said sleeve adjacent one side thereof and said thumb rest being connected to said operator arm adjacent an opposite side of said sleeve, the pivoting of said operator arm by a user causing said plunger to reciprocate.

3. A reloader as set forth in claim 2, said plunger reciprocating in a first operational plane and said operator arm reciprocating in a second operational plane, said operational planes being parallel to but spaced from one anther.

4. A reloader as set forth in claim 1, said reloader comprising a thumb rest connected to said operator arm, said operator arm being located outboard of a side of said cartridge clip, and said thumb rest being located between said open and closed ends of said cartridge clip, when said cartridge clip is engaged in operational relation with said reloader.

5. A reloader as set forth in claim 4, said plunger reciprocating in a first operational plane and said operator arm reciprocating in a second operational plane, said operational planes being parallel to but spaced from one another.

6. A reloader as set forth in claim 1, said reloader comprising a spring unit continuously biasing said plunger to a ready position, said plunger being out of contact with a top cartridge already seated in said cartridge clip when said plunger is in said ready position, said plunger being reciprocated against that spring bias to move said plunger to a depress position where said top cartridge already seated in said cartridge clip is depressed to accommodate receiving another cartridge as a successor top cartridge.

7. A reloader as set forth in claim 6, said spring unit comprising a piston and a coil compression spring both seated in said sleeve, said piston bearing against said plunger as biased by said coil spring to continuously bias said plunger to said ready position.

8. A reloader as set forth in claim 6, said spring unit comprising an upstop connected with said plunger, said upstop cooperating with said plunger to locate said plunger in said ready position in response to said spring unit bias.

9. A reloader as set forth in claim 8, said upstop comprising a detent on one of said sleeve and said operator arm, and an abutment on the other of said sleeve and said operator arm, said detent being seated against said abutment to locate said plunger in said ready position.

10. A reloader as set forth in claim 1, said sleeve comprising a generally C-shaped cross-sectional configuration.

11. A reloader as set forth in claim 1, said plunger comprising a groove in a cartridge flange contact surface defined by said plunger, said groove preventing contact of a cartridge primer with said contact surface while allowing contact of a cartridge flange with said contact surface during reloading of a successor top cartridge in said cartridge clip.

12. A reloader for a cartridge clip, said cartridge clip having an open end and a closed end, said reloader comprising adapted to receive a cartridge clip in seated relation during reloading, said sleeve being open at its top end, said sleeve also being open at a section of its periphery, said open top end and open peripheral section of said sleeve allowing said cartridge clip to be engaged with and disengaged from said sleeve in a direction generally normal to said sleeve's longitudinal axis, a handle connected to said sleeve, said cartridge clip being adapted to lay against said handle when said cartridge clip is engaged in operational relation with said reloader, a user of said reloader manually gripping in one hand both said cartridge clip and said handle to aid in maintaining operational assembly of said cartridge clip with said reloader during use, a stop connected with said handle, said stop providing a support against which said closed end of said cartridge clip is abutted when said cartridge clip is engaged in operational relation with said reloader, and a plunger connected with said reloader, said plunger being manually reciprocable to depress a top cartridge already seated in said cartridge clip to accommodate receiving another cartridge as a successor top cartridge in said cartridge clip when said cartridge clip is operationally engaged with said reloader.

13. A reloader as set forth in claim 12, said reloader comprising a latch device connected to said sleeve, said latch device being movable between a latch position where a cartridge clip is restrained within said sleeve and an unlatch position where said cartridge clip can be removed from operational assembly with said reloader.

14. A reloader as set forth in claim 12, said reloader comprising an operator arm connected with said plunger for reciprocating said plunger, said operator arm being manually operable by a user's thumb on one of the user's hands to reciprocate said plunger while manually gripping said cartridge clip and said handle by the fingers and palm of that same one of the user's hands, thereby leaving the other of the user's hands free to reload cartridges in said cartridge clip.

15. A reloader as set forth in claim 14, said reloader comprising a thumb rest connected to said operator arm, said operator arm being pivotally connected to said sleeve adjacent one side thereof and said thumb rest being connected to said operator arm adjacent an opposite side of said sleeve, the pivoting of said operator arm by a user causing said plunger to reciprocate.

16. A reloader as set forth in claim 14, said reloader comprising a thumb rest connected to said operator arm, said operator arm being located outboard of a side of said cartridge clip, and said thumb rest being located between said open and closed ends of said cartridge clip, when said cartridge clip is engaged in operational relation with said reloader.

17. A reloader as set forth in claim 12, said reloader comprising a spring unit continuously biasing said plunger to a ready position, said plunger being out of contact with said top cartridge already seated in said cartridge clip when said plunger is in said ready position, said plunger being reciprocated against that spring bias to move said plunger to a depress position where said top cartridge already seated in said cartridge clip is depressed to accommodate receiving another cartridge as a successor top cartridge.

18. A reloader as set forth in claim 17, said spring unit comprising an upstop connected with said plunger, said upstop cooperating with said plunger to locate said plunger in said ready position in response to said spring unit bias.

19. A reloader for a cartridge clip, said cartridge clip having an open end and a closed end, said reloader comprising a sleeve adapted to receive a cartridge clip in seated relation during reloading, said sleeve being open at its top end, said sleeve also being open at a section of its periphery, a plunger connected with said reloader, said plunger being manually reciprocable to depress a top cartridge already seated in said cartridge clip to accommodate receiving another cartridge as a successor top cartridge in said cartridge clip when said cartridge clip is operationally engaged with said reloader, and an operator arm connected with said plunger for reciprocating said plunger, said operator arm being manually operable, said operator arm being oriented to at least partially close said open section of said sleeve's periphery during use of said reloader when a cartridge clip is in operational assembly therewith so as to aid in holding said cartridge clip in operational assembly with said reloader.

20. A reloader as set forth in claim 19, said reloader comprising a latch device connected to said sleeve, said latch device being movable between a latch position where a cartridge clip is restrained within said sleeve and an unlatch position where said cartridge clip can be removed from operational assembly with said reloader.

21. A reloader as set forth in claim 19, said reloader comprising a handle connected to said sleeve, said cartridge clip being adapted to lay against said handle when said cartridge clip is engaged in operational relation with said reloader, a user of said reloader manually gripping in one hand both said cartridge clip and said handle to aid in maintaining operational assembly of said cartridge clip with said reloader during use.

22. A reloader as set forth in claim 21, said reloader comprising a stop connected with said handle, said stop providing a support against which said closed end of said cartridge clip is abutted when said cartridge clip is engaged in operational relation with said reloader.

23. A reloader as set forth in claim 22, said reloader comprising a spring unit continually biasing said plunger to a ready position, said plunger being out of contact with said top cartridge already seated in said cartridge clip when said plunger is in said ready position, said plunger being reciprocated against that spring bias to move said plunger to a depressed position where said top cartridge already seated in said cartridge clip is depressed to accommodate receiving another cartridge as a successor top cartridge.

24. A reloader as set forth in claim 23, said spring unit comprising an upstop connected with said plunger, said upstop cooperating with said plunger to locate said plunger in said ready position in response to said spring unit bias.

25. A reloader as set forth in claim 24, said reloader comprising a thumb rest connected to said operator arm, said operator arm being pivotally connected to said sleeve adjacent one side thereof and said thumb rest being connected to said operator arm adjacent an opposite side of said sleeve, the pivoting of said operator arm by a user causing said plunger to reciprocate.

26. A reloader for a cartridge clip, said cartridge clip having an open end and a closed end, said reloader comprising a sleeve adapted to receive a cartridge clip in seated relation during reloading, said sleeve being open at its top end, an adjustable stop connected with said sleeve, said stop being adjustable to accommodate cartridge clips of at least first and second different lengths with said sleeve so as to present the open end of each cartridge clip, whether of said first or said second length, at about the same location relative to said sleeve when either of said first or second length cartridge clips is engaged in operational relation with said reloader, said stop providing a support against which said closed end of said cartridge clip is abutted when said cartridge clip is engaged in operational relation with said reloader, and a plunger connected with said reloader, said plunger being manually reciprocable to depress a top cartridge already seated in said cartridge clip to accommodate receiving another cartridge as a successor top cartridge in said cartridge clip when said cartridge clip is operationally engaged with said reloader.

27. A reloader as set forth in claim 26, said reloader comprising a handle connected to said sleeve, said cartridge clip being adapted to lay against said handle when said cartridge clip is engaged in operational relation with said reloader, a user of said reloader manually gripping in one hand both said cartridge clip and said handle to aid in maintaining operational assembly of said cartridge clip with said reloader during use, and said stop being connected to said handle.

28. A reloader as set forth in claim 27, said stop comprising an adjustable floor connected to said handle, said floor's connection position to said handle being changed depending on whether a cartridge clip of said first length or said second length is to be reloaded.

29. A reloader as set forth in claim 27, said stop comprising at least two grooves in said handle, said grooves being sized to receive a flange carried by said cartridge clip at said clip's closed end, that groove used when a cartridge clip is in operational relation with said reloader being dependent on whether said clip is of said first or said second length.

30. A reloader as set forth in claim 27, said reloader comprising an operator arm connected with said plunger for reciprocating said plunger, said operator arm being manually operable by a user's thumb on one of a user's hands to reciprocate said plunger while manually gripping said cartridge clip and said handle by the fingers and palm by that same one of the user's hands when said cartridge clip is in operational relation with said reloader, thereby leaving the other of the user's hands free to reload cartridges in said cartridge clip.

31. A reloader as set forth in claim 30, said reloader comprising a thumb rest connected to said operator arm, said operator arm being pivotally connected to said sleeve adjacent one side thereof and said thumb rest being connected to said operator arm adjacent an opposite side of said sleeve, the pivoting of said operator arm by a user causing said plunger to reciprocate.

32. A reloader as set forth in claim 30, said reloader comprising a thumb rest connected to said operator arm, said operator arm being located outboard of a side of said cartridge clip, and said thumb rest being located between said open end and said closed end of said cartridge clip, when said cartridge clip is engaged in operational relation with said reloader.

33. A reloader as set forth in claim 30, said reloader comprising a spring unit continuously biasing said plunger to said ready position, said plunger being out of contact with said top cartridge already seated in said cartridge clip when said cartridge is in said ready position, said plunger being reciprocated against that spring bias to move said plunger to a depress position where said top cartridge already seated in said cartridge clip is depressed to accommodate receiving another cartridge as a successor top cartridge.

* * * * *

UNITED STATES PATENT AND TRADEMARK OFFICE

CERTIFICATE OF CORRECTION

PATENT NO. : 5,249,386

DATED : October 5, 1993

INVENTOR(S) : Robert D. Switzer

It is certified that error appears in the above-indentified patent and that said Letters Patent is hereby corrected as shown below:

Column 2, line 49, after "clip", insert --11--.

Column 4, line 30, after "clip", insert --11--.

Column 5, line 11, after "clip", insert --11--.

Column 7, line 39, before "adapted", insert --a sleeve--.

Signed and Sealed this

Fifth Day of July, 1994

Bruce Lehman

*Attest:*

BRUCE LEHMAN

*Attesting Officer*

*Commissioner of Patents and Trademarks*